US007415218B2

(12) United States Patent
Hori et al.

(10) Patent No.: US 7,415,218 B2
(45) Date of Patent: Aug. 19, 2008

(54) IMAGE FORMING APPARATUS HAVING CHARGING UNIT WITH SEPARATE INTAKE AND EXHAUST DUCTS

(75) Inventors: Takashi Hori, Osaka (JP); Kuniaki Nakano, Kyoto (JP); Tomohiko Fujii, Nara (JP); Yoshie Iwakura, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 11/172,805

(22) Filed: Jul. 5, 2005

(65) Prior Publication Data

US 2006/0024083 A1 Feb. 2, 2006

(30) Foreign Application Priority Data

Jul. 6, 2004 (JP) ..... 2004-199646

(51) Int. Cl.
*G03G 21/20* (2006.01)

(52) U.S. Cl. ..... 399/92; 399/93

(58) Field of Classification Search ..... 399/91–93, 399/98

See application file for complete search history.

(56) References Cited

U.S. PATENT DOCUMENTS

RE30,897 E * 4/1982 Yamamoto et al. ..... 399/93
5,376,994 A * 12/1994 Mama et al. ..... 399/93
6,339,688 B1 * 1/2002 Cho et al. ..... 399/93
6,463,236 B2 * 10/2002 Morikami et al. ..... 399/93
7,016,628 B2 * 3/2006 Maeda et al. ..... 399/171
7,136,613 B2 * 11/2006 Sato et al. ..... 399/299
2006/0275048 A1 * 12/2006 Nishimura et al. ..... 399/92

FOREIGN PATENT DOCUMENTS

JP 5-289590 A 11/1993
JP 10-307526 A 11/1998
JP 2002-229302 A 8/2002
JP 2003-191526 A 7/2003

* cited by examiner

*Primary Examiner*—David M Gray
*Assistant Examiner*—Erika J. Villaluna
(74) *Attorney, Agent, or Firm*—Birch, Stewart, Kolasch & Birch, LLP

(57) ABSTRACT

In an image forming apparatus that uses a charging unit to charge a photosensitive drum, forms an electrostatic latent image by carrying out image exposure according to image information, and transfers to a paper the electrostatic latent image by developing the electrostatic latent image into a visible image using a developer so that the image information is presented, an exhaust duct 33 for exhausting air that contains ozone produced within a drum unit 30, which includes a photosensitive drum 3 and a charging unit 5, and a duct 32 for taking in air, which draws in fresh air, are provided within the drum unit 30 so that ventilation of the drum unit 30 can be carried out with excellent efficiency.

10 Claims, 6 Drawing Sheets

IMAGE FORMING APPARATUS HAVING CHARGING UNIT WITH SEPARATE INTAKE AND EXHAUST DUCTS

CROSS REFERENCE TO RELATED APPLICATIONS

This application claims priority under 35 U.S.C. § 119(a) on Patent Application No. 2004-199646 filed in Japan on Jul. 6, 2004, the entire contents of which are hereby incorporated by reference.

BACKGROUND OF THE INVENTION

The present invention relates to electrophotographic image forming apparatuses such as copying machines, laser printers, and facsimile machines, and more specifically relates to image forming apparatuses of a mode in which a surface of a photosensitive drum (electrostatic latent bearing member) is charged by a charging unit such as a corona charging unit.

As electrophotographic image forming apparatuses such as copying machines, there are monochrome image forming apparatuses that form black and white images, and color image forming apparatuses that form color images. As color image forming apparatuses there are image forming apparatuses of a multiple rotation mode in which toner images of each color component are formed in order on a single photosensitive body by way of toner image formation means for each color (black, cyan, magenta, and yellow) as disclosed in Japanese Patent Application No. 2003-191526 for example, and image forming apparatuses of a tandem mode in which a plurality of toner image formation means, which form toner images of the color components approximately simultaneously on separate respective photosensitive bodies, are arranged serially along a carrying direction of an intermediate transfer material.

On the other hand, corona charging units such as a corotron charging unit using a wire and a case as disclosed in Japanese Patent Application No. 2002-229302 for example, and a scorotron charging unit that uses a wire (discharging electrode), a case, and a grid electrode to stabilize an electric potential on the surface of a photosensitive body, are widely used as charging units for electrophotographic image forming apparatuses. In particular, scorotron charging units offer the advantage of being able to stably control the electric potential on the surface of a photosensitive body by using a grid arranged between the discharging electrode and the surface of the photosensitive body.

In this regard, ozone is produced inside the charging unit when using a corona charging unit as the charging unit, which presents a problem of image deterioration when the produced ozone becomes residual and adversely affects the surface of the photosensitive drum. Furthermore, there is a problem that developer spatters during the development process and the inside of the apparatus becomes soiled by the spattered developer. Conventionally, in order to solve such problems, systems are employed in which an exhaust fan or the like is used to provide centralized ventilation within the apparatus main unit.

However, with conventional ventilation systems, air in the vicinity of the fixing device is also drawn so that the heat produced by the fixing device exerts an adverse influence on the image formation process. For example, toner blocking, thermal deformation of the apparatus housing and other problems occur. To avoid this influence, it has been necessary to install the fixing device and the portion for image formation processing apart from each other at a fixed distance, which presents an obstacle to miniaturization of the apparatus. Furthermore, when carrying out ventilation for the entire apparatus including the vicinity of the fixing device, it has been necessary to use a large capacity exhaust fan and a dedicated duct, which also presents an obstacle to miniaturization.

Further still, with centralized ventilation systems, the ventilation within the charging units installed in the portion for image formation processing is incomplete, which makes it impossible to avoid image deterioration and reduced life of the image formation process due to such factors as ozone damage to the photosensitive drums and nitrogen oxides adhering to the grid of the charging units.

SUMMARY OF THE INVENTION

The present invention has been devised in consideration of these issues, and it is an object thereof to provide an image forming apparatus of a mode in which the surface of the photosensitive drum is charged by a charging unit such as a corona charging unit, structured such that the ozone produced within the charging unit can be reliably and efficiently removed.

In order to achieve the above-mentioned object, an image forming apparatus of an embodiment of the present invention is an image forming apparatus that uses a charging unit to charge a photosensitive drum as an electrostatic latent bearing member, forms an electrostatic latent image by carrying out image exposure according to image information, and transfers to a paper the electrostatic latent image by developing the electrostatic latent image into a visible image using a developer so that the image information is presented, wherein an exhaust duct for exhausting air that contains ozone produced within a drum unit, which includes the photosensitive drum and the charging unit, is formed within the drum unit.

With a configuration of an image forming apparatus of an embodiment of the present invention, a duct is formed within the drum unit and therefore air that contains ozone can be reliably exhausted outside the apparatus without air that contains ozone produced within the charging unit being leaked outside the drum unit. Moreover, by forming a dedicated duct within the drum unit, it becomes possible to efficiently remove ozone produced in the charging unit while achieving miniaturization of the overall apparatus.

In an image forming apparatus of an embodiment of the present invention, it is preferable that a duct for taking in air that draws in fresh air is formed within the drum unit in addition to the exhaust duct for exhausting air containing ozone. By forming separate dedicated ducts for drawing in and exhausting air within the drum unit, there is no mixing of the fresh air drawn into the charging unit and the air that contains ozone produced within the charging unit, and therefore ventilation of the charging case can be carried out with excellent efficiency.

Further still, in an image forming apparatus of an embodiment of the present invention, it is preferable that the duct for taking in air is linked to within the charging unit via an air intake opening and the exhaust duct is linked to within the charging unit via an air exhaust opening. By separately providing the air intake opening and the air exhaust opening to within the charging unit, it is possible to exhaust the ozone produced in the charging unit with excellent efficiency.

When an image forming apparatus of an embodiment to which the present invention is applied is a color image forming apparatus in which a plurality of photosensitive drums are arranged, it is preferable that the above-mentioned ducts are arranged corresponding respectively to each of the photosensitive drums.

In a configuration of an image forming apparatus of an embodiment of the present invention, it is preferable that the air intake opening and the air exhaust opening are provided in a side wall of the charging unit, and the air intake opening is arranged at an upstream side in a rotation direction of the photosensitive drum and the air exhaust opening is arranged at a downstream side in the rotation direction of the photosensitive drum. Furthermore, it is preferable that the air intake opening is arranged at an upstream portion in an airflow direction of a duct and the air exhaust opening is arranged at a downstream portion in the airflow direction of the duct. By arranging the air intake opening and the air exhaust opening in this manner, fresh air drawn into the drum unit can flow easily within the charging unit via the duct, and therefore ozone that is residual inside the charging unit can be exhausted with excellent efficiency.

In a configuration of an image forming apparatus of an embodiment of the present invention, it is preferable that an aperture area of the air intake opening is smaller than the air exhaust opening. By causing the sizes of the air intake opening and the air exhaust opening to be different in this way, it is possible to exhaust the air that contains ozone produced in the charging unit with excellent efficiency.

In a configuration of an image forming apparatus of an embodiment of the present invention, it is preferable that, at the exhaust duct provided corresponding to the photosensitive drum, a collecting duct is connected to a downstream portion in an airflow direction thereof and an exhaust fan is provided by which air collected in the collecting duct is exhausted via an ozone removal filter. When such a configuration is employed in a color image forming apparatus or the like, it is possible to exhaust with excellent efficiency the ozone produced by a plurality of charging units using a single exhaust fan. Moreover, the air can be exhausted outside the apparatus after ozone has been removed from the air by the ozone removal filter, and therefore it is possible to prevent the escape of ozone to the surrounding environment.

DESCRIPTION OF THE PREFERRED EMBODIMENTS

Hereinafter, embodiments of the present invention will be described with reference to the accompanying drawings.

<Description of Image Forming Apparatus>

First, an image forming apparatus to which the present invention is applied will be described with reference to FIG. 1.

Figure 1:
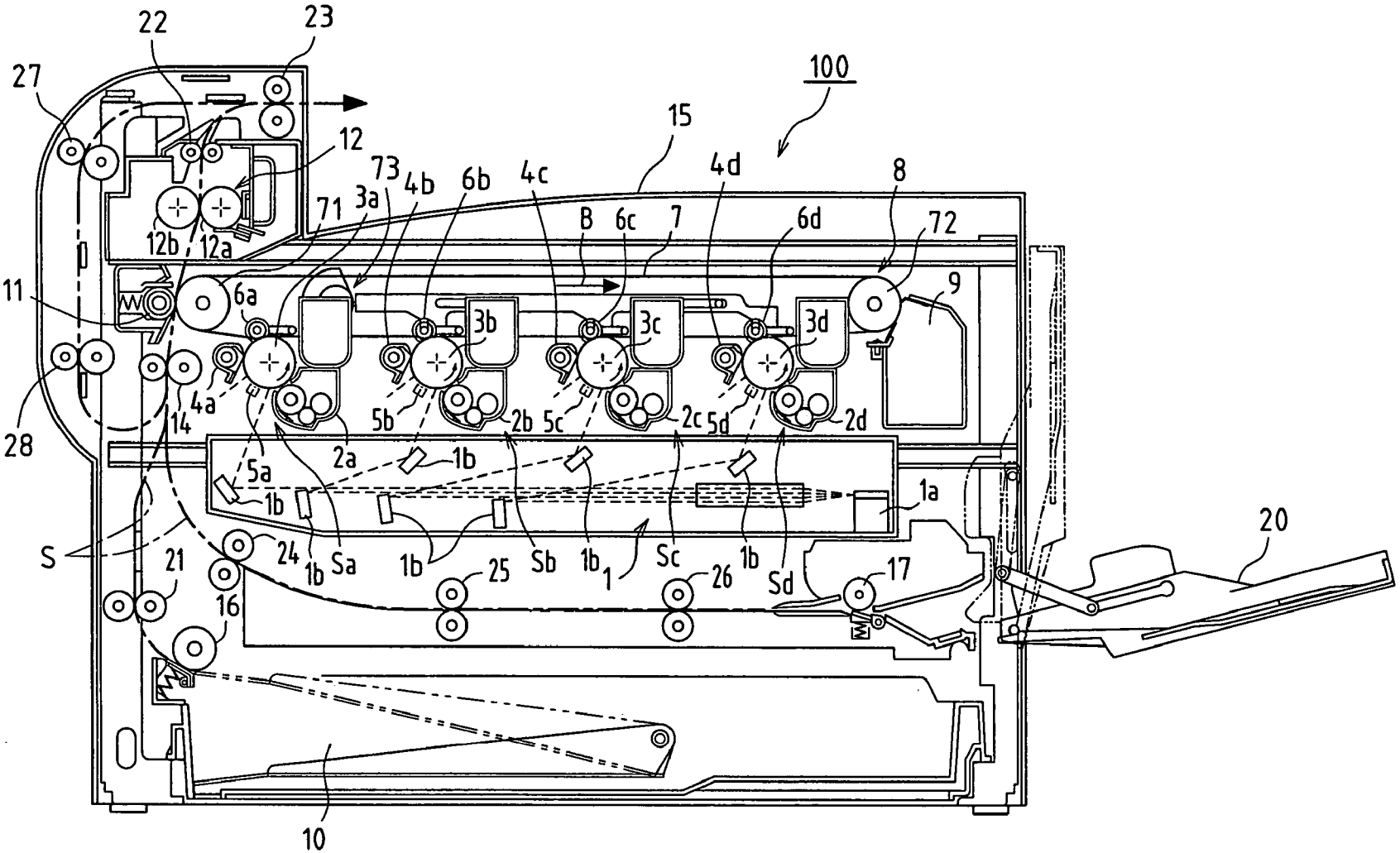
FIG. 1 schematically shows a configuration of an image forming apparatus to which the present invention is applied.

An image forming apparatus 100 shown in FIG. 1 is a color tandem system image forming apparatus that forms multicolor and single-color images on recording paper (sheets) in response to image data transmitted from an external portion and is constituted by an exposure unit 1, developing devices 2*a* to 2*d*, photosensitive drums 3*a* to 3*d*, charging units 5*a* to 5*d*, cleaner units 4*a* to 4*d*, an intermediate transfer belt 7, an intermediate transfer belt unit 8, a fixing unit 12, a paper carry path S, a paper supply tray 10, a paper exhaust tray 15 and other components.

Image data handled in the image forming apparatus 100 corresponds to color images using the colors black (K), cyan (C), magenta (M), and yellow (Y). Accordingly, as shown in FIG. 1, four each of the developing devices 2*a* to 2*d*, photosensitive drums 3*a* to 3*d*, charging units 5*a* to 5*d*, and cleaner units 4*a* to 4*d* are provided corresponding respectively to the four colors (K, C, M, and Y) to form four latent images, and these are configured in four image stations Sa to Sd that correspond to the four colors (K, C, M, and Y). It should be noted that the symbol "a" corresponds to black, "b" corresponds to cyan, "c" corresponds to magenta, and "d" corresponds to yellow.

The photosensitive drums 3*a* to 3*d* are arranged at an upper portion of the image forming apparatus 100.

Figure 7:
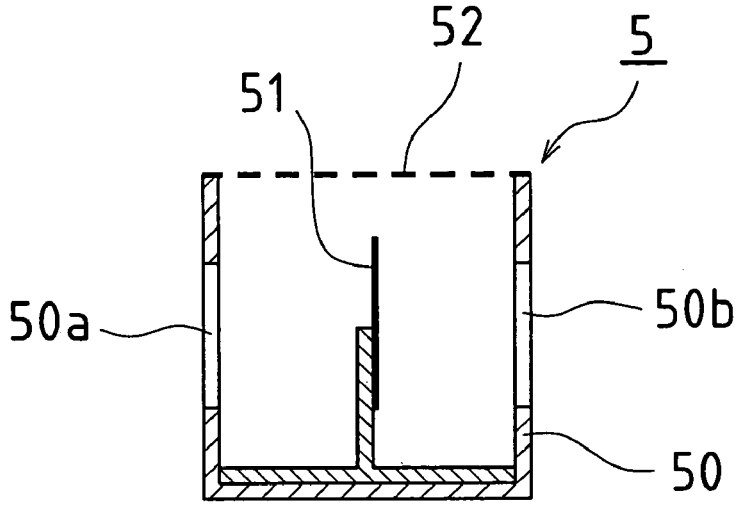
FIG. 7 is a cross-sectional view that schematically shows a configuration of a charging unit used in a working example of the present invention.

The charging units 5*a* to 5*d* are changing means for uniformly charging the surfaces of the photosensitive drums 3*a* to 3*d* to a predetermined electric potential. Corona charging units are used in the example here as shown in FIG. 7 having a blade-shaped discharging electrode 51, a net-like grid 52, and a charging case 50 that covers the discharging electrode 51.

The exposure unit 1 has the function of forming electrostatic latent images on the surfaces of the photosensitive drums 3*a* to 3*d* according to input image data by exposing the charged photosensitive drums 3*a* to 3*d* according to the image data. A laser scanning unit (LSU) including a laser irradiation portion 1*a* and reflector mirrors 1*b* is used in the exposure unit 1. It should be noted that, for example, an EL or LED writing head in which light-emitting elements are arranged in an array may also be used as the exposure unit 1.

The developing devices 2*a* to 2*d* use toner of each color (K, C, M, and Y) to turn the electrostatic latent images respectively formed on the photosensitive drums 3*a* to 3*d* into manifest images. The cleaner units 4*a* to 4*d* remove and collect toner that is residual on the surface of the photosensitive drums 3*a* to 3*d* after development and image transfer.

An intermediate transfer belt unit 8 is arranged above the photosensitive drums 3*a* to 3*d*. The intermediate transfer belt unit 8 is provided with an intermediate transfer belt 7, an intermediate transfer belt drive roller 71, an intermediate transfer belt tension mechanism 73, an intermediate transfer belt following roller 72, intermediate transfer rollers 6*a* to 6*d*, and an intermediate transfer belt cleaning unit 9. The intermediate transfer belt 7 spans in a tensioned state the intermediate transfer belt drive roller 71, the intermediate transfer belt tension mechanism 73, the intermediate transfer rollers 6*a* to 6*d*, the intermediate transfer belt following roller 72 and the like, which rotationally drive the intermediate transfer belt 7 into the direction of arrow B.

The intermediate transfer rollers 6*a* to 6*d* are rotationally supported on intermediate transfer roller mounting portions (not shown in drawings) of the intermediate transfer belt tension mechanism 73 in the transfer belt unit 8, and apply a transfer bias for transferring the toner images on the photosensitive drums 3*a* to 3*d* to the intermediate transfer belt 7.

The intermediate transfer belt 7 is provided so as to contact the respective photosensitive drums 3*a* to 3*d* and a color toner image (a multicolor toner image) is formed on the intermediate transfer belt 7 by the respective color toner images formed on the photosensitive drums 3*a* to 3*d* being superimposed and transferred in order to the intermediate transfer belt 7. The intermediate transfer belt 7 is formed as an endless shape using a film of a thickness in the range of 100 μm to 150 μm. It should be noted that only the photosensitive drum 3*a* of black (K) contacts the intermediate transfer belt 7 when performing monochrome printing.

Transfer of the toner images from the photosensitive drums 3*a* to 3*d* to the intermediate transfer belt 7 is carried out by the intermediate transfer rollers 6*a* to 6*d* that are in contact with the rear side of the intermediate transfer belt 7. A high voltage transfer bias (a high voltage (+) that has inverse polarity to the charge polarity (−) of the toner) is applied to the intermediate transfer rollers 6*a* to 6*d* to achieve transfer of the toner image.

The intermediate transfer rollers 6*a* to 6*d* are based on metal (for example stainless steel) axles with a diameter of 8 to 10 mm and the surfaces thereof are covered by a conductive elastic material (for example, EPDM and urethane foam or the like). With this conductive elastic material, it is possible to apply a uniform high voltage to the intermediate transfer belt 7. It should be noted that in this example the intermediate transfer rollers 6*a* to 6*d* are used as the transfer electrodes, but it is also possible to use other objects such as brushes.

As described above, the electrostatic images that are made as manifest images according to each hue on the photosensitive drums 3*a* to 3*d* are layered onto the intermediate transfer belt 7 and become image information that has been input to the apparatus. In this way, with the rotation of the intermediate transfer belt 7, the layered image information is transferred to a sheet of recording paper by the transfer roller 11 that is arranged at a contact position between the sheet of recording paper, which will be described later, and the intermediate transfer belt 7.

At this time, the intermediate transfer belt 7 and the transfer roller 11 are pressed against each other by a predetermined nip and a voltage (a high voltage (+) that has inverse polarity to the charge polarity (−) of the toner) is applied to the transfer roller 11 in order for the toner to be transferred to the sheet of recording paper. Moreover, in order to steadily obtain the above-mentioned nip, it is preferable that either the transfer roller 11 or the above-mentioned intermediate transfer belt drive roller 71 is provided as a hard material (metal etc.) and the other of these is provided as a soft material such as an elastic roller (an elastic rubber roller or a foam resin roller for example).

Furthermore, as described above, the toner that adheres to the intermediate transfer belt 7 by contact with the photosensitive drums 3*a* to 3*d*, or the residual toner on the intermediate transfer belt 7 not transferred to the sheet of recording paper by the transfer roller 11, is a cause of mixed color toner in the next process, and is therefore removed and recovered by the intermediate transfer belt cleaning unit 9.

The intermediate transfer belt cleaning unit 9 is provided with a cleaning blade for example as a cleaning member, which is a member that makes contact with the intermediate transfer belt 7, and the intermediate transfer belt 7 with which this cleaning blade is brought into contact is supported from the rear side by the intermediate transfer belt following roller 72.

A paper supply tray 10 is for storing the sheets of recording paper (recording sheets) that are to be used for image formation and is arranged under the exposure unit 1 of the image forming apparatus 100. Furthermore, the paper discharge tray 15 arranged in an upper portion of the image forming apparatus 100 is for loading the printed sheets of recording paper face down.

A substantially vertical sheet carry path S is provided in the image forming apparatus 100 for sending the sheets of recording paper in the paper supply tray 10 to the paper discharge tray 15 via the transfer roller 11 and the fixing unit 12. Further still, arranged in the vicinity of the sheet carry path S from the paper supply tray 10 to the paper discharge tray 15 are a pickup roller 16, a register roller 14, the transfer roller 11, the fixing unit 12, and carry rollers 21 to 28 that carry the sheets of recording paper.

The carry rollers 21 to 28 are small-size rollers that are used to facilitate and assist the carrying of the sheets of recording paper and a plurality of these are provided along the sheet carry path S.

The pickup roller 16 is provided at an end portion of the paper supply tray 10. The pickup roller 16 is a pull-in roller that supplies recording paper sheet by sheet from the paper supply tray 10 to the sheet carry path S. The register roller 14 temporarily holds the sheets of recording paper that are carried in the sheet carry path S and carries each sheet of recording paper to the transfer roller 11 with a timing that aligns a leading edge of the toner image on the intermediate transfer belt 7 and a leading edge of the sheet of recording paper.

The fixing unit 12 is provided with a heat roller 12*a*, a pressure roller 12*b* and the like. The heat roller 12*a* and the pressure roller 12*b* are configured so as to rotate and sandwich the sheet of recording paper.

Furthermore, the heat roller 12*a* is set so as to attain a predetermined fixing temperature by control based on a signal from an unshown temperature detector, and melts, mixes, and presses the multicolor toner image transferred to the sheet of recording paper to thermally fix [the multicolor toner image] to the sheet of recording paper by applying thermo compression to the sheet of recording paper along with the pressure roller 12*b*.

It should be noted that the sheet of recording paper on which the multicolor toner image has been fixed is carried on an inverted discharge path of the sheet carry path S by the carry rollers 22 and 23 and discharged to the paper discharge tray 15 in an inverted state (with the multicolor toner image facing down).

The following is a detailed description of the path by which the paper is carried.

First, arranged in this example of the image forming apparatus 100 are the paper supply tray 10 to store sheets of recording paper in advance and a manual loading tray 20 so that opening and closing of the paper supply tray 10 is not required when the user is to print a small number of sheets. The paper supply tray 10 and the manual loading tray 20 carry out feeding of the recording paper sheet by sheet to the carry path with a method using the pickup rollers 16 and 17 positioned respectively at end portions of the trays 10 and 20.

A sheet of recording paper carried from the paper supply tray 10 is carried to the register roller 14 by the carry roller 21 on the carry path, then carried to the transfer roller 11 with a timing in which the leading edge of the sheet of recording paper and the leading edge of the image information on the intermediate transfer belt 7 are matching such that the image information is written onto the sheet of recording paper. After this, unfixed toner on the sheet of recording paper is melted and fixed with heat by the passing of the sheet of recording paper through the fixing device 12, and the sheet is discharged (when single-side printing is requested) to the paper discharge tray 15 from the paper discharging unitoller 23 via the carry roller 22.

On the other hand, a sheet of recording paper loaded in the manual loading tray 20 is supplied by the pickup roller 17 and reaches the register roller 14 via a plurality of carry rollers 26, 25, and 24, after which it is discharged (when single-side printing is requested) to the paper discharge tray 15 via the same process as the sheet of recording paper supplied from the paper supply tray 10.

If the requested printing here is double sided printing, after single sided printing is completed as described above the trailing edge of the sheet of recording paper that has passed through the fixing unit 12 is held back by the discharging carry roller 23 and guided to the carry rollers 27 and 28 by the reverse rotation of the paper discharging carry roller 23. Reverse side printing is then carried out via the register roller 14 after which the sheet is discharged to the paper discharge tray 15.

WORKING EXAMPLE

Next, characteristic aspects (working examples) of the present invention will be described with reference to FIGS. 2 to 8.

Figure 2:
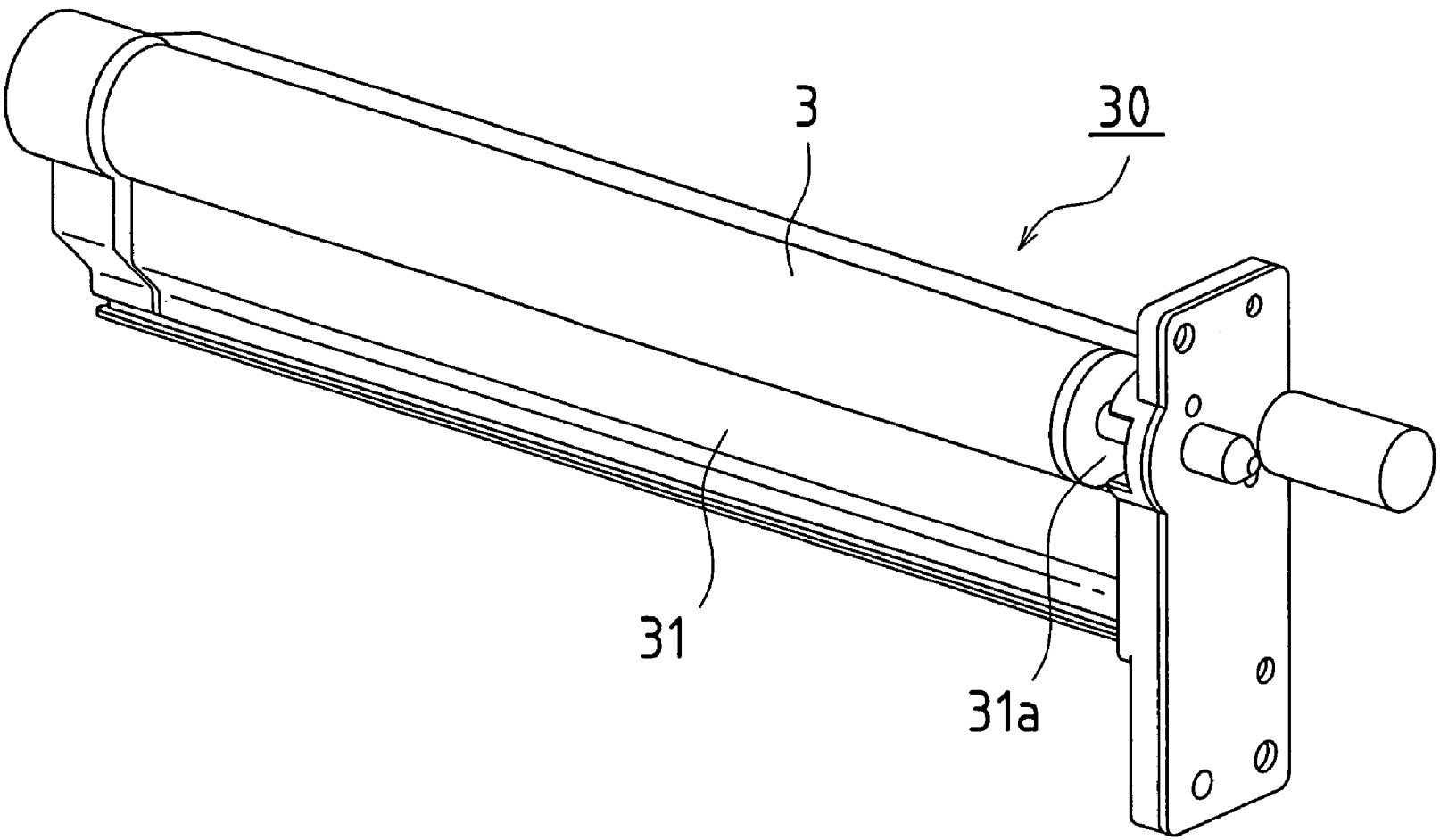
FIG. 2 is an external perspective view (front side) of a working example of a drum unit.
Figure 3:
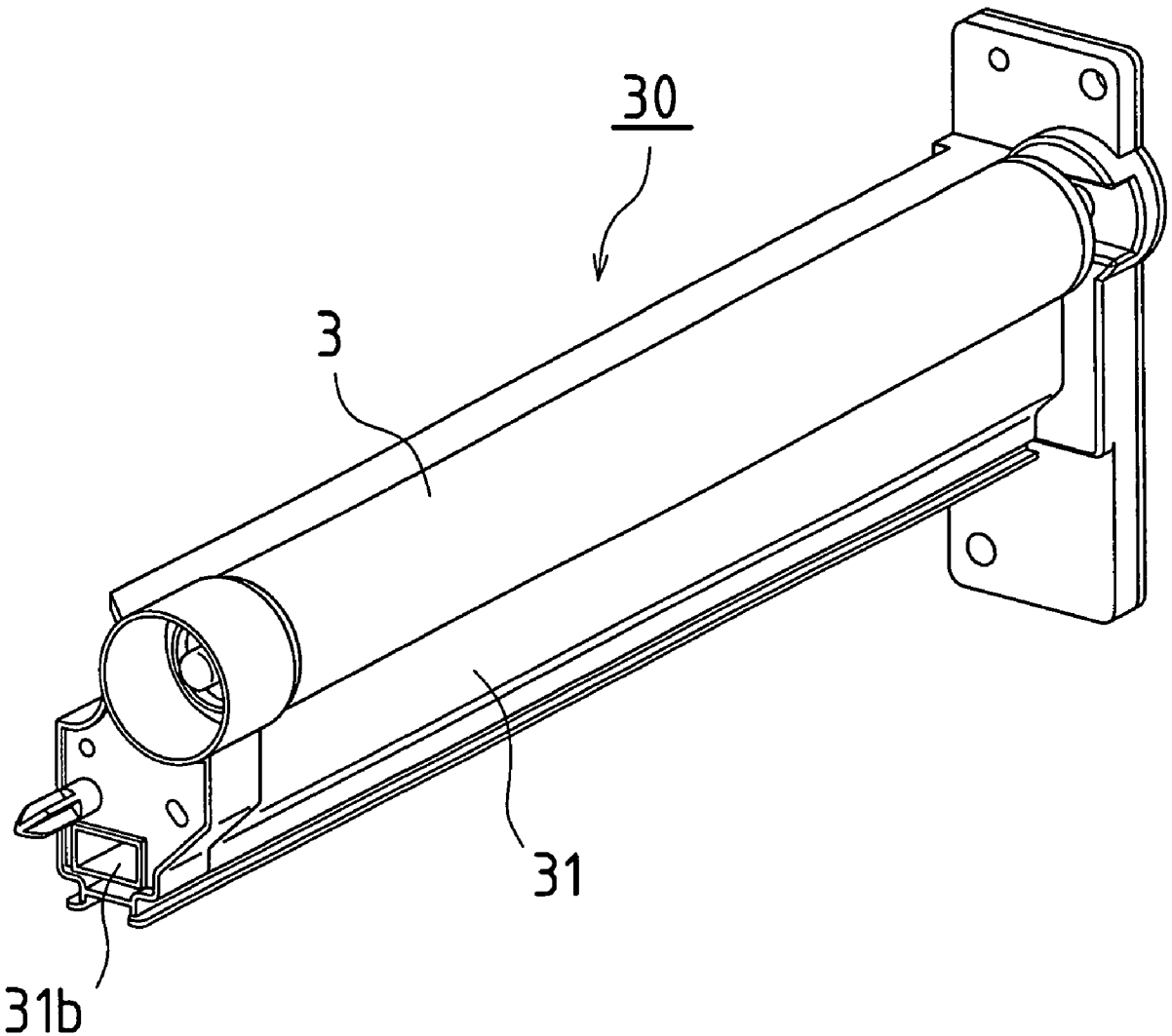
FIG. 3 is an external perspective view (rear side) of a working example of a drum unit.
Figure 4:
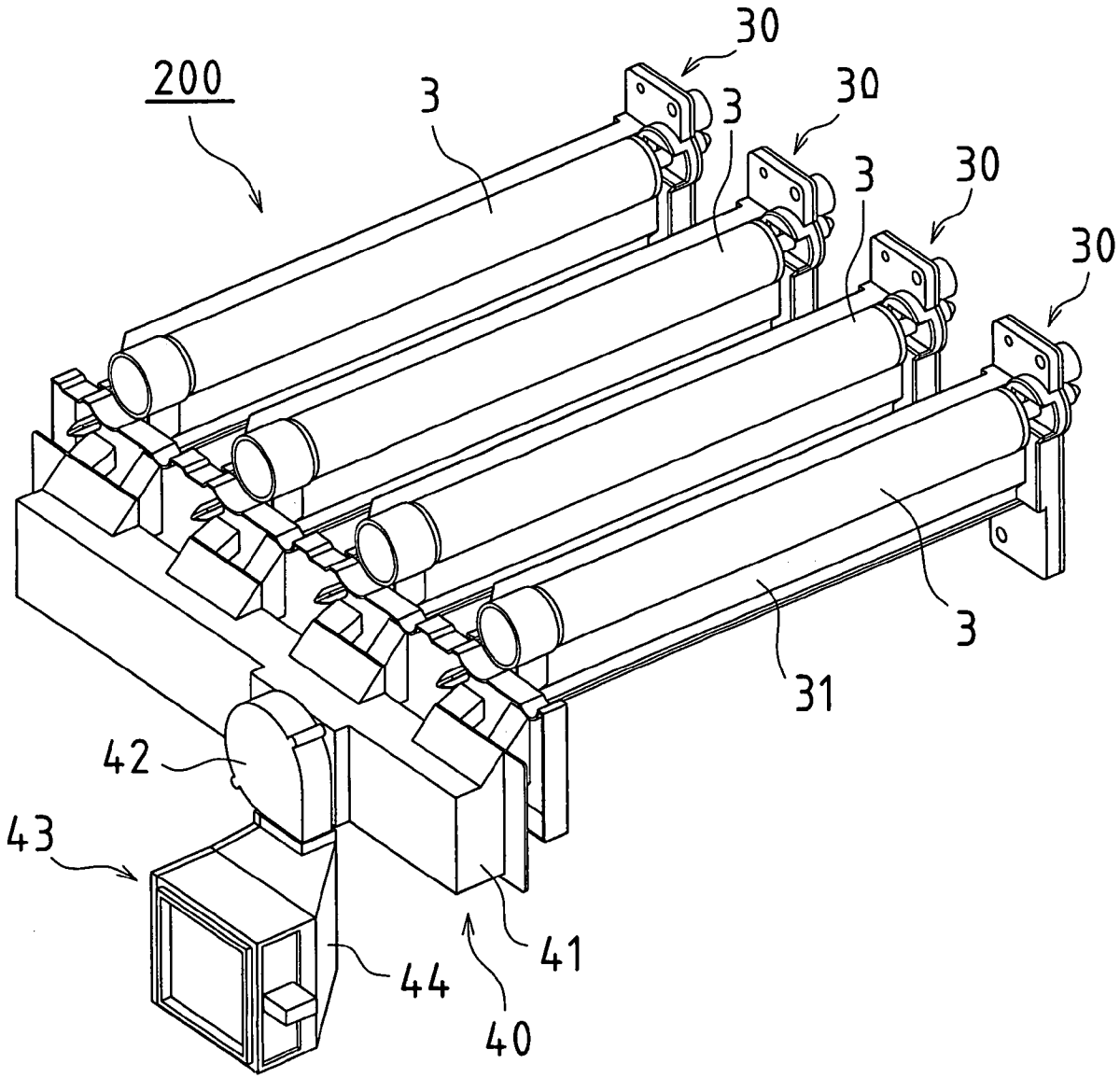
FIG. 4 is an external perspective view of a ventilation unit that incorporates the drum unit and an exhaust mechanism.

First, in this example, the four photosensitive drums 3*a* to 3*d* (hereinafter, each photosensitive drum is referred to as "photosensitive drum 3") and the charging units 5*a* to 5*d* (hereinafter, each charging unit is referred to as "charging unit 5") that correspond to each color of the image forming apparatus 100 are integrally configured in a respective drum unit 30. External views of the drum unit 30 are shown in FIGS. 2 and 3. Furthermore, FIG. 4 shows an external view of a ventilation unit 200 that integrates the four drum units 30 and incorporates an exhaust mechanism 40 that will be described later.

Figure 5:
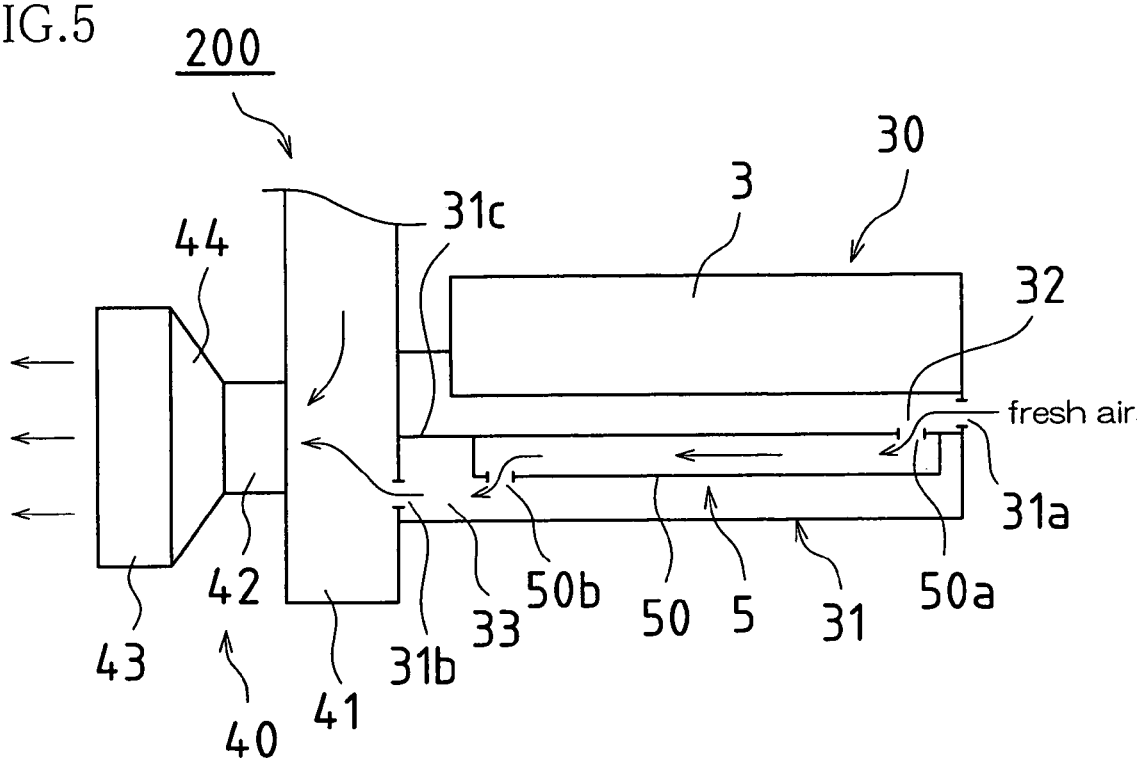
FIG. 5 schematically shows an airflow of the ventilation unit.

As shown in FIGS. 2, 3, and 5, an air introducing opening 31*a* and an air ejection opening 31*b* are provided in a unit case 31 of the drum unit 30.

Figure 8:
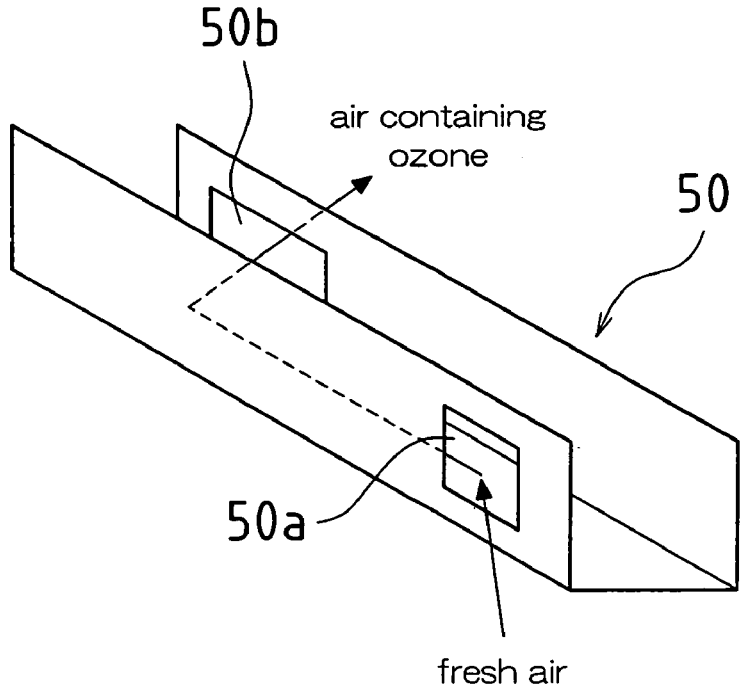
FIG. 8 is a perspective view that schematically shows a charging case of the charging unit shown in FIG. 7.

The charging unit 5 is accommodated inside the unit case 31. The charging unit 5 is a corona charging unit and, as shown in FIG. 7, is provided with a blade-shaped discharging electrode 51, a net-like grid 52, and a charging case 50 that covers the discharging electrode 51. An air intake opening 50*a* and an air exhaust opening 50*b* are provided at opposing side walls in the charging case 50 of the charging unit 5. As shown in FIG. 8, the air intake opening 50*a* and the air exhaust opening 50*b* are arranged at end portions of the charging unit 5 in the longitudinal direction. Moreover, the air intake opening 50*a* is arranged at an upstream side in the rotation direction of the photosensitive drum 3 and the air exhaust opening 50*b* is arranged at a downstream side in the rotation direction of the photosensitive drum 3 (see FIG. 6). Furthermore, the aperture area of the air intake opening 50*a* is smaller than the air exhaust opening 50*b*.

Figure 6:
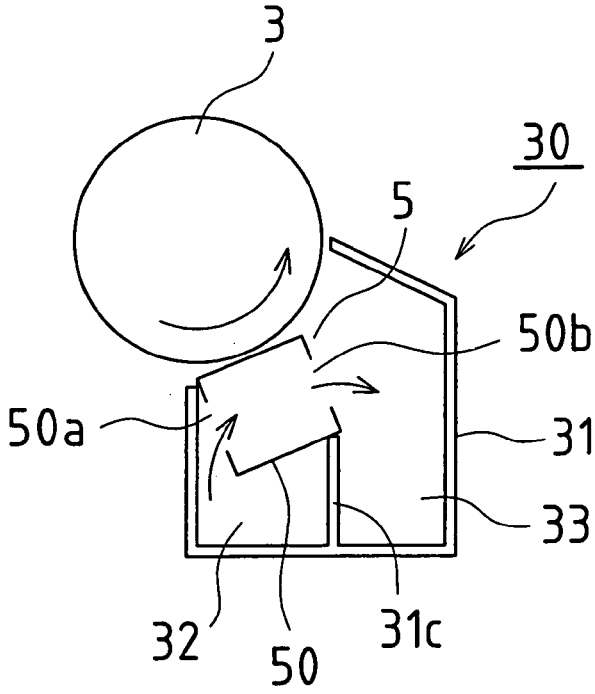
FIG. 6 schematically shows a cross sectional structure of the drum unit.

As shown in FIG. 6, a rib 31*c* for partitioning is provided in the unit case 31 and two ducts 32 and 33 are formed in the unit case 31 by this rib 31*c*. Of the two ducts 32 and 33, the duct 32 (the duct of the lower area of the charging unit 5) is a duct for taking in air and it links to the air intake opening 50*a* of the charging case 50. The other duct, duct 33, is a duct for exhausting air and it links to the air exhaust opening 50*b* of the charging case 50. Further still, the duct 32 for taking in air is linked to the air introducing opening 31*a* of the unit case 31, and the duct 33 for exhausting air is linked to the air ejection opening 31*b* of the unit case 31. Accordingly, as shown in FIG. 5, an air flow passage (flow path) is formed in the drum unit 30 that runs from the air introducing opening 31*a* of the unit case 31 to the duct 32 for taking in air, to the air intake opening 50*a* of the charging case 50, to inside the charging case 50, to the air exhaust opening 50*b* of the charging case 50, to the duct 33 for exhausting air, to the air ejection opening 31*b* of the unit case 31.

The exhaust mechanism 40 is provided with a collecting duct 41 that links to all the air ejection openings 31*b* of the four drum units 30, an exhaust fan 42 that exhausts air within the collecting duct 41, and an ozone removal filter 43 arranged on the ejection side of the exhaust fan 42. It should be noted that the ejection opening of the exhaust fan 42 and the ozone removal filter 43 are connected via a hopper shaped duct 44. Furthermore, the type of filter used for the ozone removal filter 43 is a honeycomb structured filter for example, in which ozone is adsorbed and removed by activated carbon positioned on side surfaces of the honeycomb portion.

When the exhaust fan 42 is operated in the above-described structure, in addition to fresh air being drawn into the charging unit 5 via the air introducing opening 31*a* of the unit case 31, the duct 32 for taking in air, and the air intake opening 50*a* of the charging case 50, air containing the ozone produced by the discharging electrode 51 of the charging unit 5 is sucked into the collecting duct 41 of the exhaust mechanism 40 via the air exhaust opening 50*b* of the charging case 50, the duct 33 for exhausting air, and the air ejection opening 31*b* of the unit case 31, so that the exhaust air flow from each of the drum units 30 is confluent in the collecting duct 41. Then, after ozone is removed by the ozone removal filter 43 from the air that is thus collected, the air is exhausted outside the apparatus.

In the example here, the air intake opening 50*a* and the air exhaust opening 50*b* are respectively arranged at an upstream portion and a downstream portion of the charging case 50 of the charging unit 5. Moreover, the air intake opening 50*a* and the air exhaust opening 50*b* are provided on opposing side walls and therefore, by operating the exhaust fan 42, it is possible to create an airflow that flows smoothly from the upstream portion of the charging case 50 to the downstream portion, and air containing ozone produced by the discharging electrode 51 can be exhausted outside the charging case 50 with good efficiency.

Further still, the duct 32 for taking in air and the duct 33 for exhausting air are formed in the drum unit 30 in a separated state, and therefore it is possible to carry out ventilation within the charging case 50 with good efficiency without mixing the fresh air that is drawn in by the operation of the exhaust fan 42 and the air that contains ozone produced by the discharging electrode 51 Furthermore, by providing in the drum unit 30 the ducts 32 and 33 which are dedicated for drawing in and exhausting air, it is possible to prevent ozone escaping from the drum unit 30 into other units and it is also possible to achieve miniaturization of the overall apparatus.

The present invention can be embodied and practiced in other different forms without departing from the spirit and essential characteristics thereof. Therefore, the above-described embodiments are considered in all respects as illustrative and not restrictive. The scope of the invention is indicated by the appended claims rather than by the foregoing description. All variations and modifications falling within the equivalency range of the appended claims are intended to be embraced therein.

What is claimed is:

1. An image forming apparatus comprising:

a charging unit having a charging case;

a photosensitive drum as an electrostatic latent image bearing member and extending in a longitudinal direction, the charging unit charging the photosensitive drum during an image forming operation;

a developer unit containing developer;

a drum unit including a unit case and the photosensitive drum with the charging unit included in the unit case; and an exhaust duct formed within the unit case for exhausting air that contains ozone produced within the drum unit, wherein the charging case extends in the longitudinal direction, an inside of the charging case is part of an air flow path in the drum unit, the photosensitive drum forms an electrostatic latent image by carrying out image exposure according to image information, and transfers the electrostatic latent image to a paper by developing the electrostatic latent image into a visible image using the developer in the developer unit so that the image information is presented, a duct for taking in air that draws in fresh air is formed within the unit case in addition to and separate from the exhaust duct for exhausting air containing ozone, both the exhaust duct and the duct for taking in air extending in the longitudinal direction of the charging case, the duct for taking in air is linked to the air flow path inside the charging case via an air intake opening and the exhaust duct is linked to the air flow path inside the charging case via an air exhaust opening, the air intake opening and the air exhaust opening are provided in opposing side walls of the charging case of the charging unit, the opposing side walls extending in the longitudinal direction with the air intake opening arranged in one side wall at an end portion corresponding to an upstream side of the air flow path and the air exhaust opening arranged in the opposing sidewall at the end portion corresponding to a downstream side of the air flow path, and the air intake opening is arranged at an upstream side in a rotation direction of the photosensitive drum and the air exhaust opening is arranged at a downstream side in the rotation direction of the photosensitive drum.

2. The image forming apparatus according to claim 1, wherein a plurality of the photosensitive drums are provided and the ducts corresponding to each of the photosensitive drums are provided.

3. The image forming apparatus according to claim 2, wherein, at the exhaust duct provided corresponding to the photosensitive drum, a collecting duct is connected to a downstream portion in an airflow direction thereof and an exhaust fan is provided by which air collected in the collecting duct is exhausted via an ozone removal filter.

4. The image forming apparatus according to claim 1, wherein the air intake opening is arranged at an upstream portion in an airflow direction of the duct and the air exhaust opening is arranged at a downstream portion in the airflow direction of the duct.

5. The image forming apparatus according to claim 4, wherein an aperture area of the air intake opening is smaller than the air exhaust opening.

6. The image forming apparatus according to claim 5, wherein, at the exhaust duct provided corresponding to the photosensitive drum, a collecting duct is connected to a downstream portion in an airflow direction thereof and an exhaust fan is provided by which air collected in the collecting duct is exhausted via an ozone removal filter.

7. The image forming apparatus according to claim 4, wherein, at the exhaust duct provided corresponding to the photosensitive drum, a collecting duct is connected to a downstream portion in an airflow direction thereof and an exhaust fan is provided by which air collected in the collecting duct is exhausted via an ozone removal filter.

8. The image forming apparatus according to claim 1, wherein an aperture area of the air intake opening is smaller than the air exhaust opening.

9. The image forming apparatus according to claim 8, wherein, at the exhaust duct provided corresponding to the photosensitive drum, a collecting duct is connected to a downstream portion in an airflow direction thereof and an exhaust fan is provided by which air collected in the collecting duct is exhausted via an ozone removal filter.

10. The image forming apparatus according to claim 1, wherein, at the exhaust duct provided corresponding to the photosensitive drum, a collecting duct is connected to a downstream portion in an airflow direction thereof and an exhaust fan is provided by which air collected in the collecting duct is exhausted via an ozone removal filter.

* * * * *